US011333428B2

(12) United States Patent
Yukishita et al.

(10) Patent No.: US 11,333,428 B2
(45) Date of Patent: May 17, 2022

(54) HEAT INSULATING STRUCTURE FOR COOLING DEVICE, AND COOLING DEVICE

(71) Applicant: PHC HOLDINGS CORPORATION, Tokyo (JP)

(72) Inventors: Masato Yukishita, Gunma (JP); Tadashi Okada, Saitama (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 17/103,868

(22) Filed: Nov. 24, 2020

(65) Prior Publication Data

US 2021/0080168 A1 Mar. 18, 2021

Related U.S. Application Data

(63) Continuation of application No. PCT/JP2019/019434, filed on May 16, 2019.

(30) Foreign Application Priority Data

May 25, 2018 (JP) ..... JP2018-100878

(51) Int. Cl.
*F25D 23/06* (2006.01)
*F25D 23/08* (2006.01)
*F25D 23/02* (2006.01)

(52) U.S. Cl.
CPC ..... *F25D 23/065* (2013.01); *F25D 23/069* (2013.01); *F25D 23/082* (2013.01); (Continued)

(58) Field of Classification Search
CPC .... F25D 23/065; F25D 23/028; F25D 23/082; F25D 23/069; F25D 2201/12; F25D 2201/14
See application file for complete search history.

(56) References Cited

U.S. PATENT DOCUMENTS 4,884,415 A * 12/1989 Mandel ..... F25D 21/04 62/277
5,600,966 A * 2/1997 Valence ..... F25D 11/04 312/401

(Continued)

FOREIGN PATENT DOCUMENTS

JP H11-159950 A 6/1999
JP 2002-364978 A 12/2002

(Continued)

OTHER PUBLICATIONS

Extended European Search Report dated May 25, 2021, issued in corresponding European Patent Application No. 19807594.7.

(Continued)

*Primary Examiner* — Daniel J Rohrhoff
(74) *Attorney, Agent, or Firm* — McDermott Will & Emery LLP

(57) ABSTRACT

The invention is provided with a housing which has an inner space open in a first direction, a partition body which divides the inlet of the inner space into a plurality of openings arranged next to each other in a second direction perpendicular to the first direction, a door which is provided to each of the openings and which closes the opening from the first direction side, a first vacuum heat insulating material which is disposed inside the partition body, and a second vacuum heat insulating material which is disposed inside the door. The first vacuum heat insulating material and the second vacuum heat insulating material are arranged so as to overlap each other when viewed from the first direction side or from the second direction side.

9 Claims, 6 Drawing Sheets

(52) U.S. Cl.
CPC ..... *F25D 23/028* (2013.01); *F25D 2201/12* (2013.01); *F25D 2201/14* (2013.01)

(56) References Cited

U.S. PATENT DOCUMENTS

| | | | | |
|---|---|---|---|---|
| 6,036,294 | A * | 3/2000 | Banicevic | F25D 23/069 312/296 |
| 9,835,370 | B2 * | 12/2017 | Jung | F25D 23/025 |
| 10,731,915 | B2 * | 8/2020 | Gillette | F25D 25/025 |
| 2005/0138955 | A1 * | 6/2005 | Okuda | F25D 23/025 62/441 |
| 2015/0030800 | A1 | 1/2015 | Jung et al. | |
| 2018/0238609 | A1 * | 8/2018 | Uchida | F25D 23/06 |
| 2019/0003759 | A1 | 1/2019 | Arai et al. | |
| 2020/0173717 | A1 * | 6/2020 | Du | F25D 23/021 |

FOREIGN PATENT DOCUMENTS

| | | | |
|---|---|---|---|
| JP | 2003-172566 | A | 6/2003 |
| JP | 2004-011708 | A | 1/2004 |
| JP | 2004-028350 | A | 1/2004 |
| JP | 2005-024204 | A | 1/2005 |
| JP | 2005-147650 | A | 6/2005 |
| JP | 2012-242072 | A | 12/2012 |
| JP | 583483 | | 1/2016 |
| JP | 5843483 | | 1/2016 |
| KR | 10-2015-0012712 | A | 2/2015 |
| WO | 2017/154735 | A1 | 9/2017 |
| WO | 2017/192121 | A1 | 11/2017 |

OTHER PUBLICATIONS

International Search Report and Written Opinion issued in International Patent Application No. PCT/JP2019/019434, dated Jul. 23, 2019; with partial English translation.

International Preliminary Report on Patentability issued in International Patent Application No. PCT/JP2019/019434 dated May 19, 2020.

Office Action dated Feb. 16, 2022, issued in corresponding European Patent Application No. 19807594.7.

* cited by examiner

HEAT INSULATING STRUCTURE FOR COOLING DEVICE, AND COOLING DEVICE

CROSS-REFERENCE OF RELATED APPLICATIONS

This application is a Continuation of International Patent Application No. PCT/JP2019/019434, filed on May 16, 2019, which in turn claims the benefit of Japanese Application No. 2018-100878, filed on May 25, 2018, the entire disclosures of which Applications are incorporated by reference herein.

TECHNICAL FIELD

The present invention relates to a heat insulating structure of a cooling apparatus and a cooling apparatus using the same.

BACKGROUND ART

In a cooling apparatus such as an ultra-low-temperature freezer, the interior is typically divided into a plurality of sections.

PTL 1 discloses a configuration in which a hollow partition wall for partitioning the interior is filled with a heat insulation material, and discloses an exemplary case of using a combination of a foaming resin heat insulation material and a vacuum heat insulation material.

CITATION LIST

Patent Literature

PTL 1
Japanese Patent Application Laid-Open No. 2002-364978

SUMMARY OF INVENTION

Technical Problem

In a cooling apparatus, the heat insulating performance depends largely on the cooling performance, and it is therefore desirable to improve the heat insulating performance of the partition wall for partitioning the interior.

To meet such demands, an object of the present invention is to provide a heat insulating structure of a cooling apparatus and a cooling apparatus that can improve the heat insulating performance.

Solution to Problem

To achieve the above-mentioned object, a heat insulating structure of a cooling apparatus of the present invention includes a housing including an inner space that opens to a first direction; a partition member configured to partition an entrance of the inner space into a plurality of openings arranged in a second direction orthogonal to the first direction; a door provided for each opening to close each opening from a side of the first direction; a first vacuum heat insulation material disposed inside the partition member; and a second vacuum heat insulation material disposed inside the door. The first vacuum heat insulation material and the second vacuum heat insulation material are disposed to overlap each other as viewed from aside of the second direction.

To achieve the above-mentioned object, a heat insulating structure of a cooling apparatus of the present invention includes a housing including an inner space that opens to a first direction; a partition member configured to partition an entrance of the inner space into a plurality of openings arranged in a second direction orthogonal to the first direction; a door provided for each opening to close each opening from a side of the first direction; a first vacuum heat insulation material disposed inside the partition member, and a second vacuum heat insulation material disposed inside the door. The first vacuum heat insulation material is provided inside the partition member such that the first vacuum heat insulation material covers a front wall inner peripheral surface and the first vacuum heat insulation material and the second vacuum heat insulation material are disposed to overlap each other as viewed from the side of the first direction.

To achieve the above-mentioned object, a cooling apparatus of the present invention includes the heat insulating structure of the cooling apparatus.

Advantageous Effects of Invention

According to the present invention, the heat insulating performance of the cooling apparatus can be improved.

DESCRIPTION OF EMBODIMENTS

1. Embodiment 1

Figure 1:
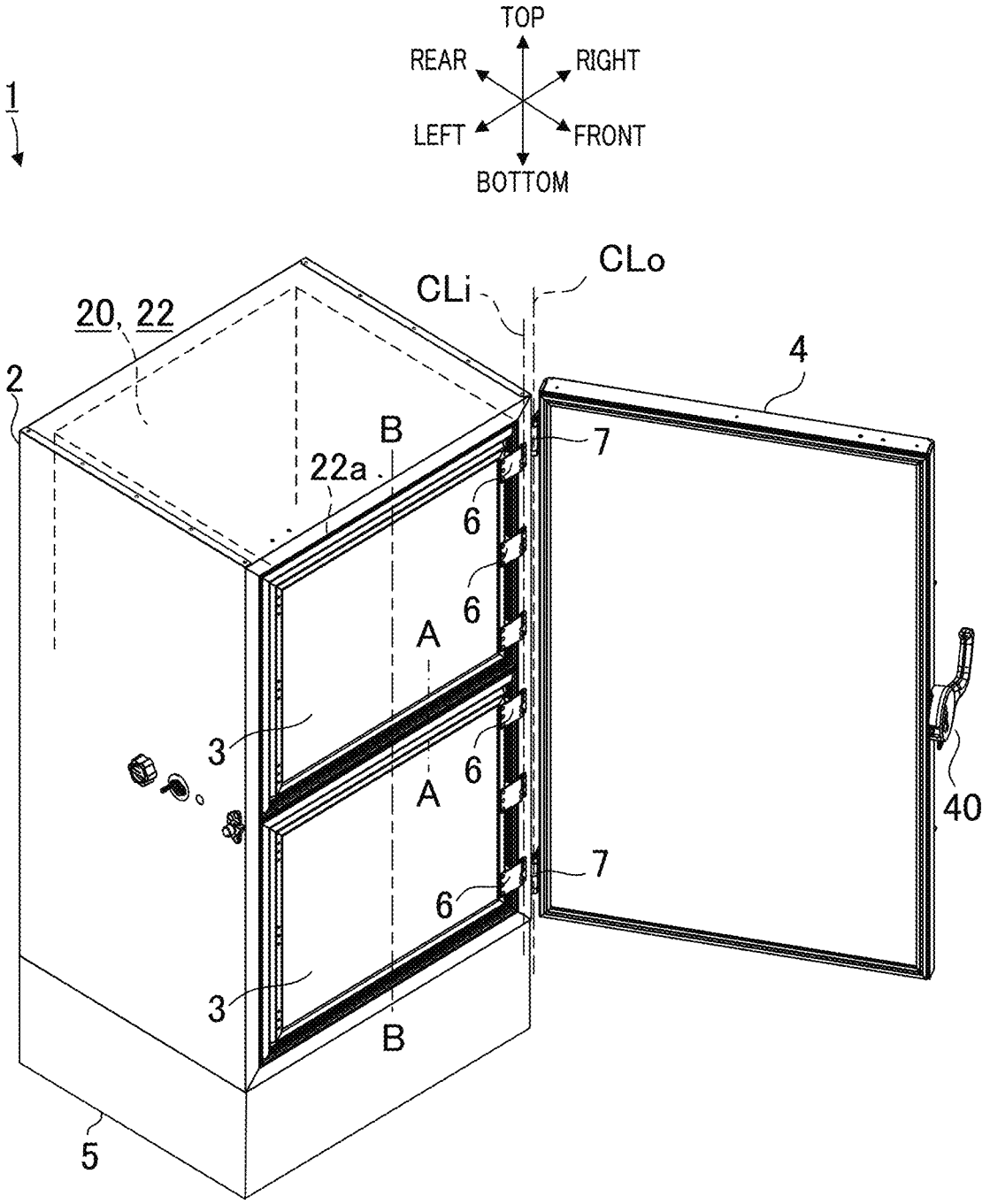
FIG. 1 is a perspective view illustrating a general configuration of an ultra-low-temperature freezer of Embodiment 1 of the present invention in the state where an outer door is open and an inner door is closed.

An embodiments of the present invention is described below with reference to the drawings. The following embodiments are only examples and do not exclude the application of various variations and techniques not expressly described in the following embodiments. Also, each of the configurations of the embodiments may be variously modified to the extent that they do not deviate from the gist of the embodiments. Furthermore, each of the configurations of the embodiments may be selected, omitted or combined as necessary.

In the following embodiments, a cooling apparatus is an ultra-low-temperature freezer is described. Note that a cooling apparatus is a concept including a freezing apparatus, a refrigerating apparatus, an ultra-low-temperature freezer, and apparatuses having their functions. In addition, an ultra-low-temperature freezer refers to an apparatus that cools the interior to an ultra-low-temperature (e.g., approximately −80° C.).

In addition, in the ultra-low-temperature freezer, the side facing the user (the side of the outer door and the inner door described later) is the front side, and the side opposite to the front side is the rear side. In addition, left and right are defined with respect to the viewing direction from the front to the rear, and the right direction and the left direction are collectively referred to as a width direction. In addition, also in the components of the ultra-low-temperature freezer, the front, rear left and right are defined with respect to a state where they are assembled in the ultra-low-temperature freezer, but the front and rear of the outer door and the inner door described later are defined with respect to a closed state.

In addition, in each diagram for describing the embodiment, the same components are basically denoted with the same reference numerals, and the description thereof may be omitted.

1-1. General Configuration of Ultra-Low-Temperature Freezer

Figure 2:
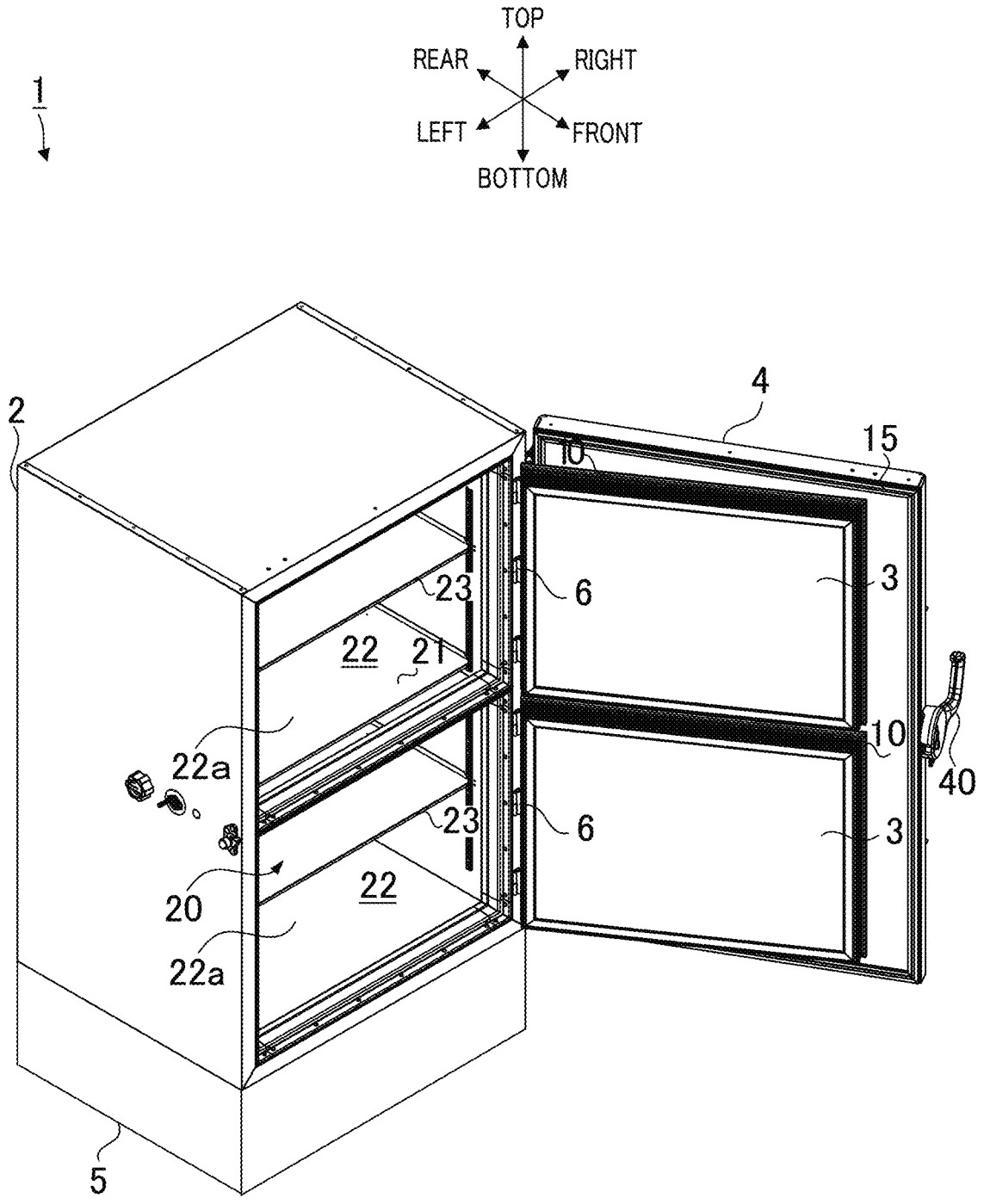
FIG. 2 is a perspective view illustrating a general configuration of the ultra-low-temperature freezer of Embodiment 1 of the present invention in the state where both the outer door and the inner door are open.

A general configuration of ultra-low-temperature freezer 1 is described below with reference to FIGS. 1 and 2. FIG. 1 is a perspective view illustrating a general configuration of an ultra-low-temperature freezer of Embodiment 1 of the present invention in the state where an outer door is open and an inner door is closed. FIG. 2 is a perspective view illustrating a general configuration of the ultra-low-temperature freezer of Embodiment 1 of the present invention in the state where both the outer door and the inner door are open.

Ultra-low-temperature freezer 1 includes housing 2, inner door 3, outer door 4 and machine chamber 5 as illustrated in FIGS. 1 and 2.

Housing 2 includes inner space 20 that opens to the front side (first direction). Inner space 20 is a space in which to house a storing object.

With partition wall 21 and partition member 26 described later provided at the front end of partition wall 21, inner space 20 is partitioned into two inner spaces 22 arranged in the up-and-down direction (arranged in a second (downward or upward) direction). In the following description, the surface facing inner space 22 in housing 2 is referred to as an inner peripheral surface. Note that with partition wall 23, each inner space 22 is further divided into two sections in the up-and-down direction.

Inner door 3 is provided for each inner space 22, and is provided in two stages on the upper and lower sides. The right end of the front surface of each inner door 3 is fixed at the right end of the front surface of housing 2 with a plurality of hinges 6 arranged in the up-and-down direction. Outer door 4 is fixed at the right end of the front surface of housing 2 on the outside (i.e., the right side) of inner door 3 with a plurality of hinges 7 provided in the up-and-down direction.

With this configuration, the entrance of inner space 22, i.e., opening 22*a* of housing 2 is opened and closed in a double manner with inner door 3 and outer door 4. More specifically, inner door 3 is horizontally swingable about rotation center line CLi extending in the up-and-down direction with the left side of inner door 3 as a swing end, and opens and closes the entrance of inner space 22, i.e., opening 22*a*, through the user operation. Outer door 4 is horizontally swingable about center line CLo extending in the up-and-down direction on the outside (i.e., the right side) of rotation center line CLi of inner door 3, and opens and closes opening 22*a* from the outside (i.e., the front side) of inner door 3.

A heat insulation material is provided in each of housing 2, inner door 3 and outer door 4 to maintain inner space 22 at a low temperature.

Further, packing 10 (sealing member) is provided at the outer periphery (the top surface, the right side surface, the bottom surface and the left side surface) of inner door 3 over the whole circumference. Likewise, packing 15 is provided at the outer periphery (the top surface, the right side surface, the bottom surface and the left side surface) of outer door 4 over the whole circumference. With packings 10 and 15, adhesion between inner door 3 and housing 2 and adhesion between outer door 4 and housing 2 when inner door 3 and outer door 4 are closed are improved, and the sealing property of inner space 22 is improved.

In addition, outer door 4 is provided with handle 40 configured to be grabbed by the user for opening and closing. Handle 40 in the present embodiment includes a lock mechanism. The lock mechanism is configured to lock closed outer door 4, and to release the locked state to open outer door 4. When outer door 4 is locked with the lock mechanism, the airtightness and the heat insulating property of ultra-low-temperature freezer 1 can be increased.

In the present embodiment, machine chamber 5 is provided in a lower portion of housing 2 to house a main part of a freezing cycle therein.

1-2. Heat Insulating Structure

Figure 3:
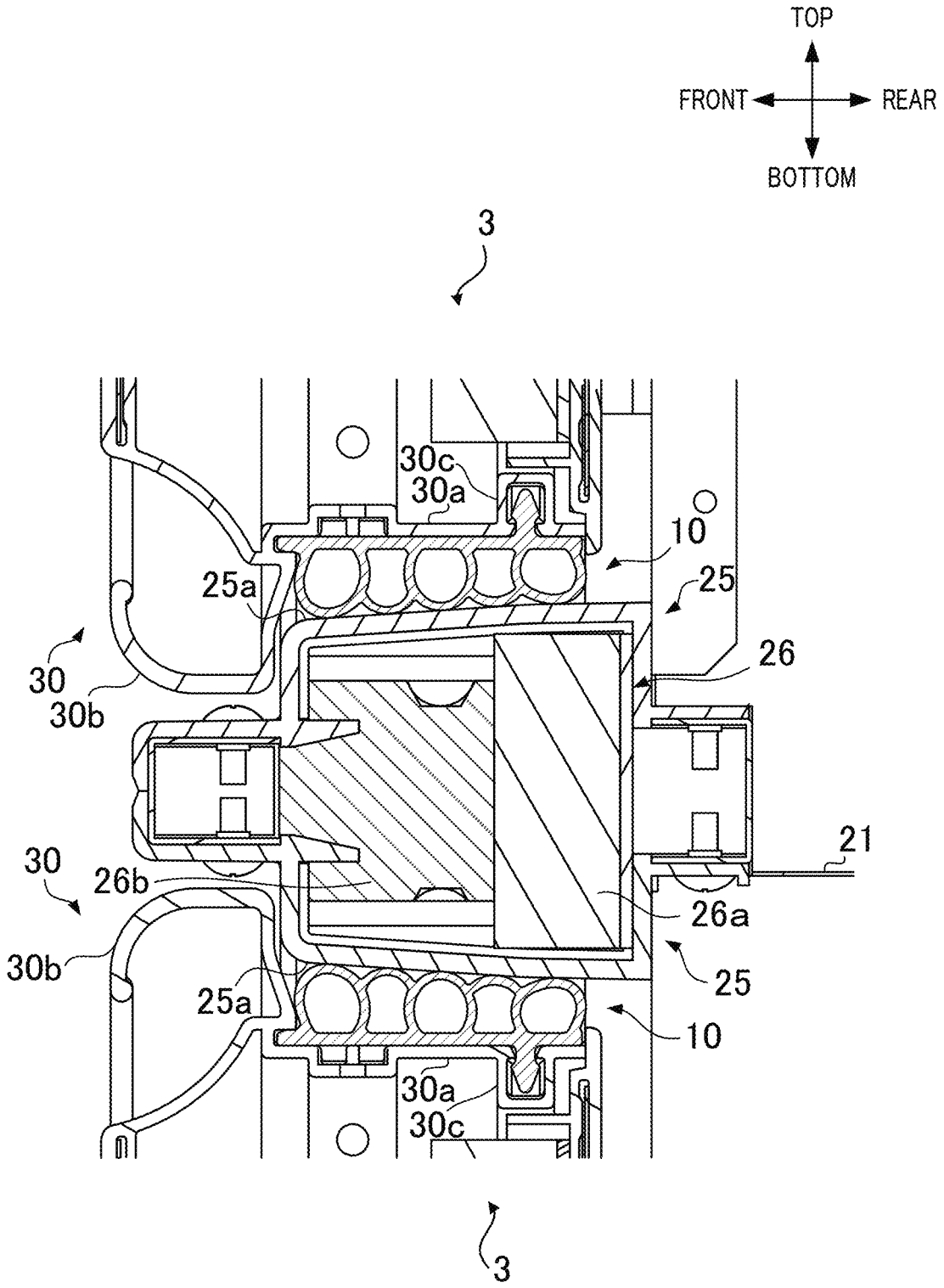
FIG. 3 is a vertical sectional view of a main part of the ultra-low-temperature freezer of Embodiment 1 of the present invention taken along line A-A of FIG. 1 as viewed from the right side.
Figure 4:
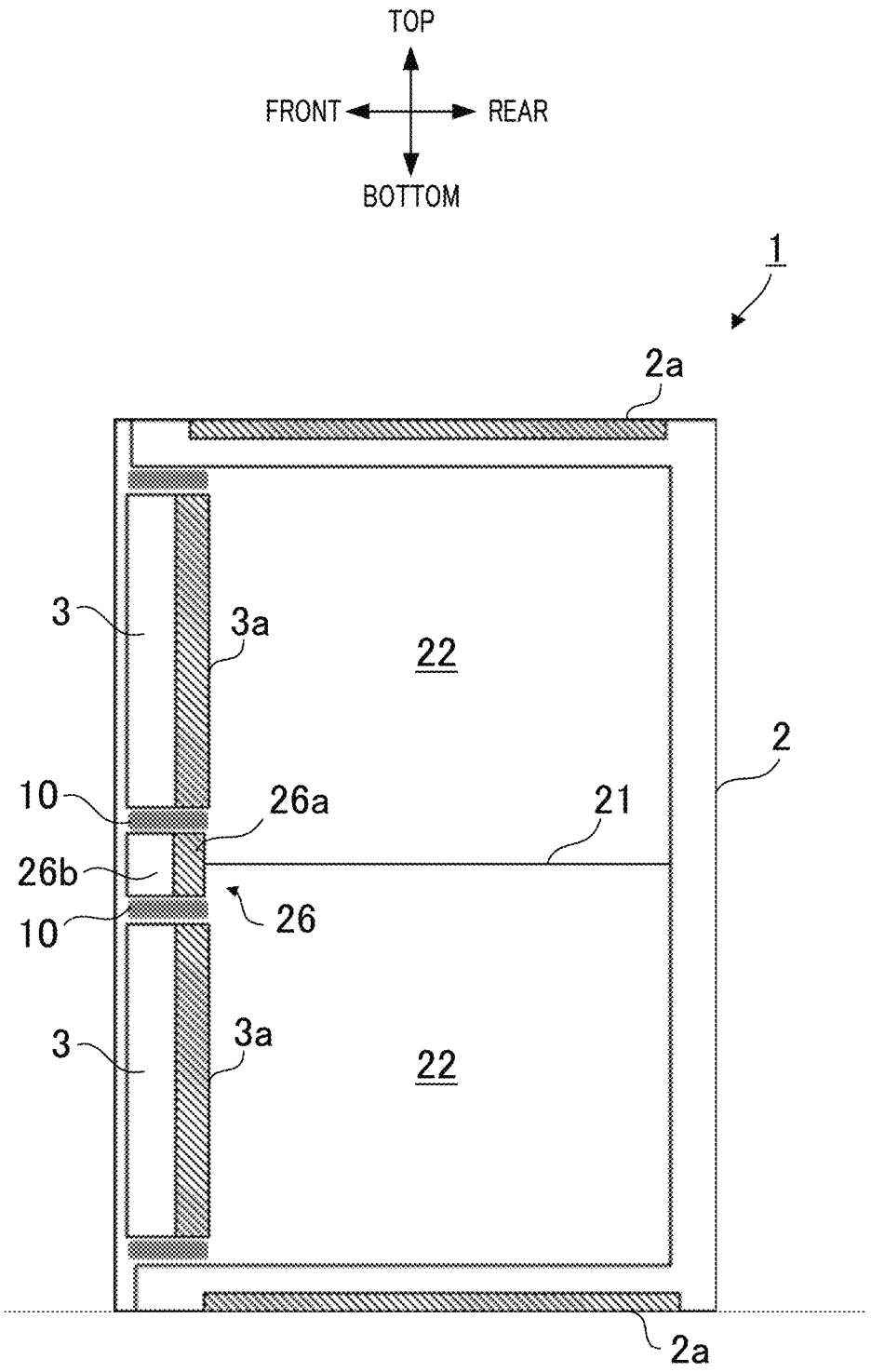
FIG. 4 is a schematic vertical sectional view illustrating an entirety of the ultra-low-temperature freezer of Embodiment 1 of the present invention taken along line B-B of FIG. 1 as viewed from the right side.

A heat insulating structure of Embodiment 1 of the present invention is described below with reference to FIGS. 3 and 4. FIG. 3 is a vertical sectional view of a main part of ultra-low-temperature freezer 1 taken along line A-A of FIG. 1 as viewed from the right side. FIG. 4 is a schematic vertical cross-sectional view of an entirety of ultra-low-temperature freezer 1 as viewed from the right side taken along line B-B of FIG. 1.

With reference to FIG. 3, first, the outer peripheral surface of each inner door 3 is composed of door breaker 30 made of resin over the whole circumference. Rear part 30*a* (hereinafter referred to also as "breaker rear part 30*a*") of door breaker 30 is generally configured to extend in the front-rear direction such that the position in the up-and-down direction is fixed in the state illustrated in FIG. 3 where inner door 3 is closed. Note that the front part of door breaker 30 is grip 30*b* to be operated by the user to open and close inner door 3 by hand, and has a curved shape for the sake of operability. Grip 30*b* functions also as a stopper for stopping inner door 3 by making contact with housing breaker 25 at the time when inner door 3 is closed.

Packing 10 is attached on the outer peripheral surface of door breaker 30 over the whole circumference. Attaching recess 30*c* recessed inward in the width direction is provided in rear part 30*a* of door breaker 30. An attaching protrusion of packing 10 is inserted to recess 30*c* from the outer circumference side. In this manner, packing 10 is fixed to the outer peripheral surface of inner door 3.

The entrance of the inner peripheral surface of housing 2 is composed of housing breaker 25 made of resin over the whole circumference. That is, housing 2 is provided with housing breaker 25 surrounding openings 22*a* arranged in the up-and-down direction (see FIG. 2).

Rear part of 25*a* of housing breaker 25 functions as a compression surface configured to compress packing 10 in the state where inner door 3 is closed. Breaker rear part 25*a* is formed as a tilted surface tilted inward (the center side in inner space 22 in the upper, lower, left and right directions) in the width direction as it goes toward the rear side (third direction). As such, rear part 25*a* is hereafter referred to as "breaker tilted surface part 25*a*". In the state where inner door 3 is closed, inner door 3 is pressed by compressed packing 10, and thus the closed state is maintained.

Upper housing breaker 25 has a shape recessed to opening 22*a* surrounded by housing breaker 25, and likewise, lower housing breaker 25 has a shape recessed to opening 22*a* surrounded by housing breaker 25. These housing breakers 25 are disposed such that the lower peripheral surface of upper housing breaker 25 and the upper peripheral surface of lower housing breaker 25 face each other. Hollow partition member 26 extending in the width direction is formed between housing breakers 25 facing each other from the upper and lower sides. Partition wall 21 horizontally (or approximately horizontally) extends from the rear surface of partition member 26 to the inner peripheral rear surface of housing 2.

Inside partition member 26, vacuum heat insulation material 26*a* extending in the width direction is disposed at a rear part, and resin heat insulation material 26*b* extending in the width direction is disposed at a front part. Resin heat insulation material 26*b* is, for example, urethane foaming resin, and is provided in the interior of partition member 26 to fill the gap between the inner peripheral surface of partition member 26 and vacuum heat insulation material 26*a*.

Next, an arrangement of vacuum heat insulation material 3*a* disposed inside inner door 3 and vacuum heat insulation material 26*a* disposed inside partition member 26 is described below with reference to FIG. 4. As illustrated in FIG. 4, inside inner doors 3 arranged in the up-and-down direction, vacuum heat insulation material 3*a* is disposed on the side that becomes a rear part when inner door 3 is in a closed state. In addition, inside partition member 26, vacuum heat insulation material 26*a* is disposed in a rear part as described above. By disposing vacuum heat insulation materials 3*a* and 26*a* in the above-mentioned manner, vacuum heat insulation materials 3*a* and 26*a* overlap each other in the front-rear direction (or in other words, overlap each other as viewed from the side of the second direction (the downward direction or the upward direction)).

Note that vacuum heat insulation material 2*a* is provided in the ceiling wall and the bottom wall of housing 2.

1-3. Advantageous Effects

Advantageous effects of Embodiment 1 of the present invention are described below with reference to FIG. 4.

(1) Vacuum heat insulation material 3*a* provided in inner door 3 and vacuum heat insulation material 26*a* provided in partition member 26 are disposed to overlap each other as viewed from the top side in the state where inner door 3 is closed. In this configuration, a heat transmission path formed in the gap between vacuum heat insulation material 3*a* and vacuum heat insulation material 26*a* is narrow, and thus the heat insulating performance of ultra-low-temperature freezer 1 can be further improved. Thus, transmission of the cold energy of inner space 22 from inner door 3 to the part between inner door 3 and outer door 4 can be suppressed, and generation of condensation and/or frost between inner door 3 and outer door 4 can be suppressed.

(2) Vacuum heat insulation material 26*a* is disposed at the front surface or the rear surface (in the present embodiment, the rear surface) inside partition member 26. In this manner, the gap from vacuum heat insulation material 3*a* of upper and lower inner doors 3 can be reduced in comparison with the case where vacuum heat insulation material 26*a* is disposed at the top surface or the bottom surface inside partition member 26, for example. Thus, with vacuum heat insulation material 26*a* having a high heat insulating performance, transmission of the external heat through partition member 26 can be suppressed.

(3) The degree of flexibility in shape of the vacuum heat insulation material is relatively low, and it is therefore difficult to mold the vacuum heat insulation material to match the inner shape in partition member 26. As such, a gap is easily formed between the inner peripheral surface of partition member 26 and vacuum heat insulation material 26*a*, but the gap can be filled by supplying resin heat insulation material 26*b* into partition member 26. This configuration can also improve the heat insulating performance of partition member 26, and in turn, the heat insulating performance of ultra-low-temperature freezer 1. In addition, while inner door 3 presses partition member 26 when inner door 3 is closed so as to be pushed into opening 22*a*, such deformation of pressed partition member 26 can be prevented since partition member 26 is reinforced by filling the gap inside partition member 26 with the resin heat insulation material.

(4) Since partition member 26 is formed between housing breakers 25 arranged in the up-and-down direction, it is not necessary to separately prepare and assemble a component for partition member 26. Thus, simplification of manufacturing processes and reduction of the manufacturing cost can be achieved.

(5) Inside partition member 26, vacuum heat insulation material 26*a*, whose volume is less varied by the temperature than resin heat insulation material 26*b*, is provided on the rear side where the temperature is lower than on the front side of inner space 22. Thus, it is possible to suppress a reduction in heat insulating property of partition member 26 due to a gap formed by shrinkage of the heat insulation material resulting from the low temperature of inner space 22.

1-4. Modification

Figure 5:
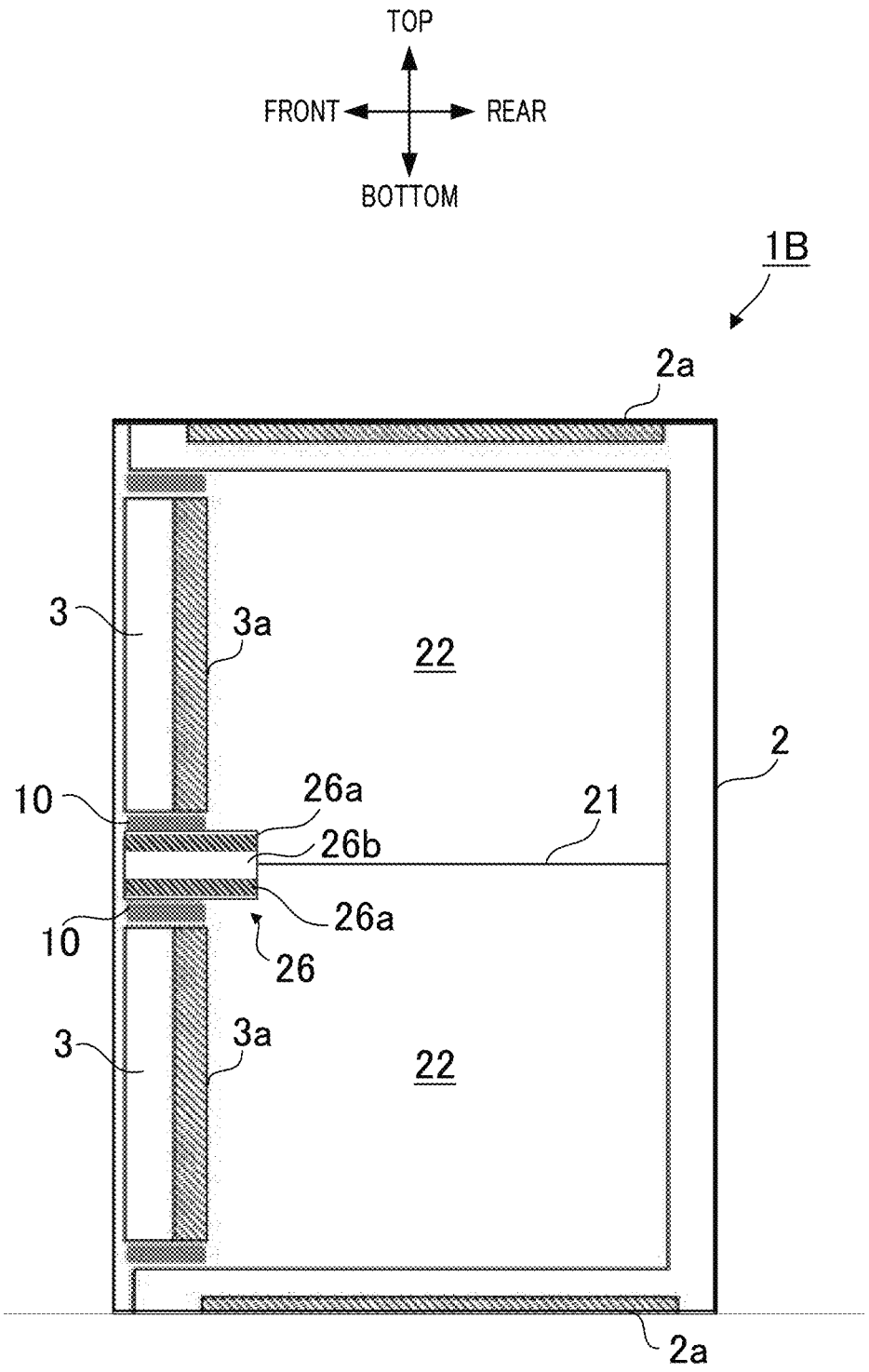
FIG. 5 is a diagram illustrating a modification of Embodiment 1 of the present invention and corresponds to FIG. 4 (a schematic vertical sectional view illustrating an entirety of the ultra-low-temperature freezer taken along line B-B of FIG. 1 as viewed from the right side)

A modification of the present embodiment is described below with reference to FIG. 5. FIG. 5 corresponds to FIG. 4 (a schematic vertical cross-sectional view of an entirety of ultra-low-temperature freezer 1 as viewed from the right side taken along line B-B of FIG. 1).

Ultra-low-temperature freezer 1B of the present modification is different from the embodiment in the internal configuration in partition member 26. More specifically, in partition member 26, horizontal vacuum heat insulation materials 26*a* extending from the front wall to the rear wall are provided on the upper wall side and on the lower wall side. A gap is provided between vacuum heat insulation materials 26*a*, and the inside of partition member 26 is filled with resin heat insulation material 26*b* to fill the gap.

With vacuum heat insulation material 26*a* disposed in the above-described manner, vacuum heat insulation materials 26*a* and vacuum heat insulation material 3*a* provided inside inner door 3 overlap each other as viewed from the bottom side or the top side (the second direction) as in the embodiment. In this manner, effects similar to those of the embodiment can be achieved.

Other configurations are similar to those of the embodiment, and therefore the description thereof is omitted.

2. Embodiment 2

Figure 6:
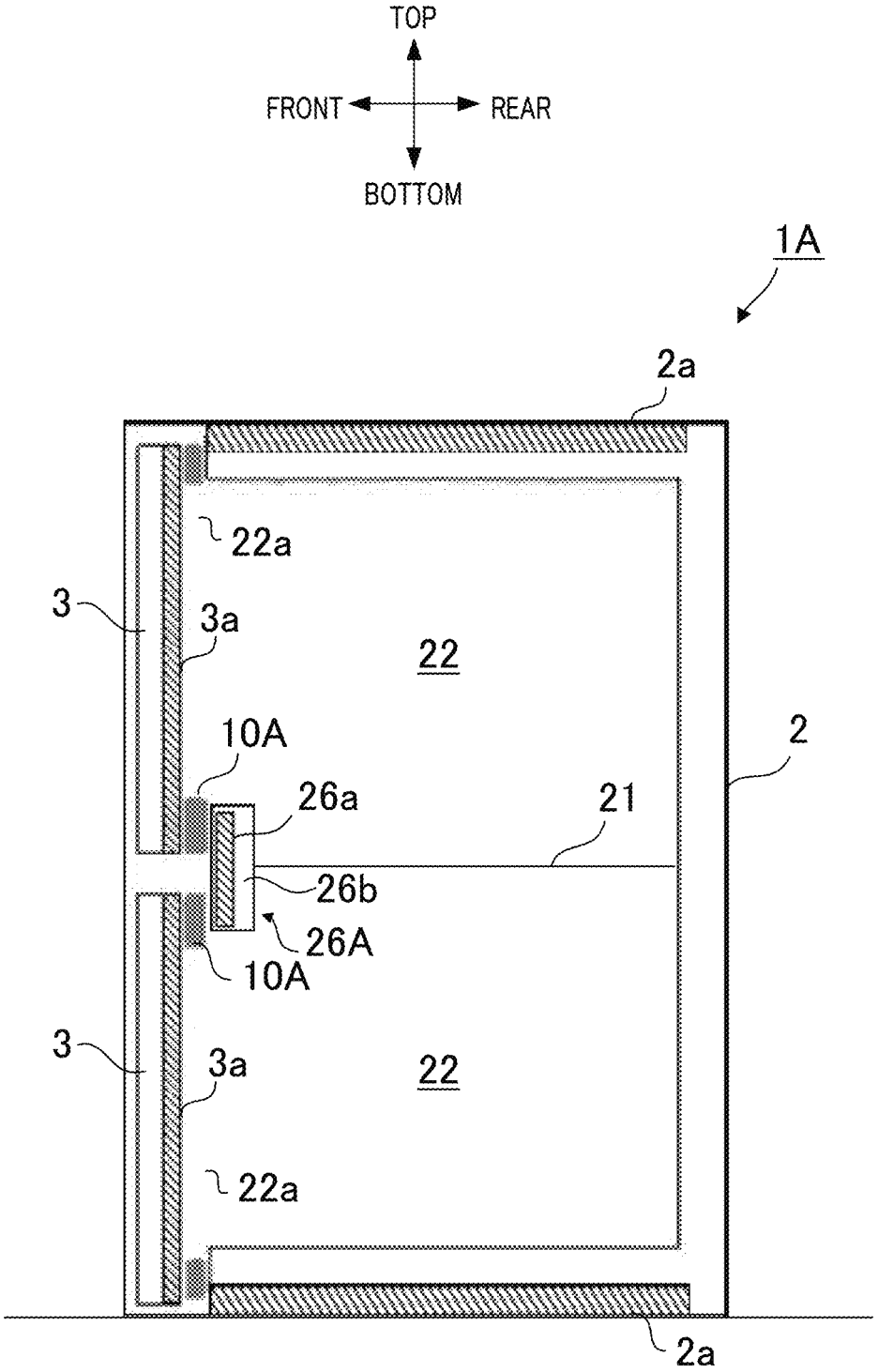
FIG. 6 is a diagram illustrating Embodiment 2 of the present invention and corresponds to FIG. 4 (a schematic vertical sectional view illustrating an entirety of the ultra-low-temperature freezer taken along line B-B of FIG. 1 as viewed from the right side).

Embodiment 2 of the present invention is described below with reference to FIG. 6. FIG. 6 corresponds to FIG. 4 (a schematic vertical cross-sectional view of an entirety of ultra-low-temperature freezer 1 as viewed from the right side taken along line B-B of FIG. 1).

In ultra-low-temperature freezer 1A of the present embodiment, packing 10A is provided around opening 22*a* at the front surfaces of housing 2 and partition member 26A. In the state where inner door 3 is closed, inner door 3 presses and compresses each packing 10A from the front side such that packing 10A is in intimate contact with inner door 3.

Inside each inner door 3, vacuum heat insulation material 3*a* is disposed so as to cover the rear wall inner peripheral surface. In addition, inside partition member 26A, vacuum heat insulation material 26*a* is disposed so as to cover the front wall inner peripheral surface, and, on the rear side of vacuum heat insulation material 26*a* resin heat insulation material 26*b* is disposed to fill the gap between vacuum heat insulation material 26*a* and the inner peripheral surface of partition member 26A. The lower end of vacuum heat insulation material 3*a* of the upper inner door 3 and the upper end of vacuum heat insulation material 26*a* of partition member 26A overlap each other as viewed from the front side. Likewise, the upper end of vacuum heat insulation material 3*a* of the lower inner door 3 and the lower end of vacuum heat insulation material 26*a* of partition member 26A overlap each other as viewed from the front side.

Other configurations are similar to those of Embodiment 1, and therefore the description thereof is omitted.

According to Embodiment 2, in ultra-low-temperature freezer 1A that differs from ultra-low-temperature freezer 1 of Embodiment 1 in the way of attaching packing 10A, vacuum heat insulation material 3*a* of inner door 3 and vacuum heat insulation material 26*a* of partition member 26A overlap each other. In this configuration, the heat transmission path formed in the gap between vacuum heat insulation material 3*a* and vacuum heat insulation material 26*a* is narrow, and thus the heat insulating performance of ultra-low-temperature freezer 1 can be improved as in Embodiment 1. In particular, since vacuum heat insulation material 26*a* is disposed on the front wall side of partition member 26A, the distance between vacuum heat insulation material 3*a* of inner door 3 on the front side of partition member 26A and vacuum heat insulation material 26*a* is short, and thus high heat insulating performance can be achieved.

3. Other Configurations (1) While resin heat insulation material 26*b* is provided in addition to vacuum heat insulation material 26*a* inside partition member 26A in the above-mentioned embodiment, only vacuum heat insulation material 26*a* may be disposed, and resin heat insulation material 26*b* may be omitted in the configurations of embodiment 1 and embodiment 2.

(2) While the heat insulating structure of the present invention is applied to inner door 3 in the embodiment, the heat insulating structure of the present invention is applicable to a partition member disposed between outer doors in a cooling apparatus including a plurality of outer doors.

The disclosure of Japanese Patent Application No. 2018-100878 filed on May 25, 2018 including the specification, claims, drawings and abstract is incorporated herein by reference in its entirety.

INDUSTRIAL APPLICABILITY

The present invention can provide a cooling apparatus with improved cooling performance. Therefore, very broad industrial applicability can be achieved.

REFERENCE SIGNS LIST

1, 1A, 1B ultra-low-temperature freezer
2 Housing
2*a* Vacuum heat insulation material
20 Inner space
21 Partition wall
22 Inner space
22*a* Opening
23 Partition wall
25 Housing breaker
25*a* Rear part, breaker Tilted surface part
26 Partition member
26*a* Vacuum heat insulation material
26*b* Resin heat insulation material
3 Inner door
3*a* Vacuum heat insulation material
30 Door breaker
30*a* Rear part
30*b* Grip
30*c* Recess
4 Outer door
40 Handle
5 Machine chamber
6, 7 Hinge
10 Packing of inner door 3
15 Packing of outer door 4
CLi Rotation center line of inner door 3
CLo Rotation center line of outer door 4

The invention claimed is:

1. A heat insulating structure of a cooling apparatus, comprising:

a housing including an inner space that opens to a first direction;

a partition member configured to partition an entrance of the inner space into a plurality of openings arranged in a second direction orthogonal to the first direction;

a plurality of inner doors provided for each opening to close a corresponding one of the plurality of openings from a side of the first direction;

a first vacuum heat insulation material disposed inside the partition member;

a second vacuum heat insulation material disposed inside each of the plurality of inner doors; and a resin heat insulation material disposed inside the partition member, wherein:

the first vacuum heat insulation material and the second vacuum heat insulation material are disposed to overlap each other as viewed from a side of the second direction, and in the partition member, the resin heat insulation material is disposed closer to the plurality of inner doors than the first vacuum heat insulation material in the first direction, and the first vacuum heat insulation material is disposed closer to the inner space than the resin heat insulation material in third direction opposite to the first direction.

2. The heat insulating structure of the cooling apparatus according to claim 1, wherein each of the plurality of inner doors is located inside the inner space when in a closed state.

3. The heat insulating structure of the cooling apparatus according to claim 1, wherein a housing breaker is provided for each opening in the housing such that housing breaker covers a periphery of each opening, the housing breaker including a recess recessed to an opening side in an outer peripheral surface; and wherein the recesses of the housing breakers adjacent to each other are combined to each other to form the partition member.

4. A cooling apparatus comprising the heat insulating structure of the cooling apparatus according to claim 1.

5. The heat insulating structure of the cooling apparatus according to claim 1, wherein the first vacuum heat insulation material extends in a width direction.

6. The heat insulating structure of the cooling apparatus according to claim 1, further comprising a packing disposed between each of the plurality of inner doors and the partition member in a state where each of the plurality of inner doors is closed, wherein the packing is disposed to overlap the first vacuum heat insulation material and the second vacuum heat insulation material as viewed from the side of the second direction.

7. The heat insulating structure of the cooling apparatus according to claim 1, further comprising an outer door over the plurality of inner doors.

8. The heat insulating structure of the cooling apparatus according to claim 1, further comprising:

a packing disposed between each of the plurality of inner doors and the partition member; and a housing breaker provided for each of the plurality of openings and having a tilted surface part tilted inward in the third direction, wherein the packing is compressed to the tilted surface when each of the plurality of inner doors is closed.

9. A heat insulating structure of a cooling apparatus, comprising:

a housing including an inner space that opens to a first direction;

a partition member configured to partition an entrance of the inner space into a plurality of openings arranged in a second direction orthogonal to the first direction;

a plurality of inner doors provided for each opening to close a corresponding one of the plurality of openings from a side of the first direction;

a first vacuum heat insulation material disposed inside the partition member;

a second vacuum heat insulation material disposed inside each of the plurality of inner doors; and a resin heat insulation material disposed inside the partition member, wherein:

the first vacuum heat insulation material is provided inside the partition member such that the first vacuum heat insulation material covers a front wall inner peripheral surface, the first vacuum heat insulation material and the second vacuum heat insulation material are disposed to overlap each other as viewed from the side of the first direction, and in the partition member, the first vacuum heat insulation material is disposed closer to the plurality of inner doors than the resin heat insulation material in the first direction, and the resin heat insulation material is disposed closer to the inner space than the first vacuum heat insulation material in third direction opposite to the first direction.

* * * * *